US006655039B2

(12) United States Patent
Hultsch

(10) Patent No.: US 6,655,039 B2
(45) Date of Patent: Dec. 2, 2003

(54) CENTRIFUGAL DRYER

(75) Inventor: Günther Hultsch, Oberschleissheim (DE)

(73) Assignee: Gunther Hultsch, Stichgart (DE)

( * ) Notice: Subject to any disclaimer, the term of this patent is extended or adjusted under 35 U.S.C. 154(b) by 0 days.

(21) Appl. No.: 09/897,452

(22) PCT Filed: Jan. 3, 2000

(86) PCT No.: PCT/EP00/00006

§ 371 (c)(1),
(2), (4) Date: Sep. 6, 2001

(87) PCT Pub. No.: WO00/40911

PCT Pub. Date: Jul. 13, 2000

(65) Prior Publication Data

US 2002/0014019 A1 Feb. 7, 2002

(30) Foreign Application Priority Data

Jan. 4, 1999 (DE) ..... 199 00 042

(51) Int. Cl.[7] ..... F26B 17/24

(52) U.S. Cl. ..... 34/58; 34/166; 34/183; 34/179; 210/787; 210/512.3

(58) Field of Search ..... 34/322, 323, 328, 34/338, 58, 166, 183, 356, 179; 210/787, 512.1, 512.3

(56) References Cited

U.S. PATENT DOCUMENTS 2,727,631 A * 12/1955 Pate ..... 210/369
3,399,773 A * 9/1968 Read ..... 210/196
3,458,045 A * 7/1969 Dudley ..... 510/95
5,265,347 A * 11/1993 Woodson et al. ..... 34/58
5,611,150 A * 3/1997 Yore, Jr. ..... 34/58
6,033,577 A * 3/2000 Braband et al. ..... 210/741

FOREIGN PATENT DOCUMENTS

GB 1047155 * 11/1966

* cited by examiner

*Primary Examiner*—Timothy L. Maust
*Assistant Examiner*—Kathryn S. O'Malley
(74) *Attorney, Agent, or Firm*—Jagtiani + Guttag

(57) ABSTRACT

For separating and drying pellets from a suspension, centrifugal dryers have proved successful wherein a rotor equipped with conveyor blades and disposed vertically in an outside housing for collecting the liquid is enclosed coaxially by a hollow body formed of screen elements.

The suspension of pellets and liquid is supplied continuously to the lower area of the space between the hollow body and the rotor. The pellets are transported upward by the conveyor blades rotating with the rotor while being thrown back and forth and dried between the conveyor blades and the screens. At the upper end of the rotor the dried pellets are thrown off. The liquid separated from the pellets passes through the screen jacket and flows out of the discharge port of the outside housing.

In a centrifugal dryer the hollow body enclosing the rotor (1, 28) equipped with conveyor blades (8, 13, 12, 27) consists of screen elements (15) only in the lower area or not at all, consisting rather of an unperforated jacket (21, 29) on whose inside wall the separated liquid flows downward in a spiral shape. An outside housing (17) is omitted in the area of the unperforated jacket.

14 Claims, 2 Drawing Sheets

CENTRIFUGAL DRYER

DESCRIPTION

This invention relates to an apparatus for a centrifugal dryer for separating and drying pellets according to the preamble of patent claim 1.

Centrifugal dryers are used for example for drying plastic pellets. Easy cleanability of the process spaces is important because when the pellet color or grade is changed one must prevent pellets or fragments of the preceding batch from mixing with the new one. Long service life of the apparatus parts, low abrasion of the pellets to be dried and low sound emissions are also important.

Known centrifugal dryers according to German laid-open prints DE 195 37 41 A1, DE 43 30 078 A1 and DE 28 19 443 A1 and according to U.S. Pat. No. 5,611,150 consist of a housing in which a hollow body formed of screens coaxially encloses a pivotally mounted, vertically disposed rotor equipped with conveyor blades. The screens either form a closed cylinder or are segmented. They extend from the bottom up to the pellet discharge zone located at the upper end, being interrupted only by fastening elements and possibly a feed chute.

The suspension of pellets and liquid is supplied continuously to the lower area of the centrifugal dryers, into the space between the rotor and the hollow body formed of screens. It is caught by the corotating conveyor blades of the rotor which transfer both an upward directed transport pulse and centrifugal forces to the suspension. The pellets are thereby both transported upward and thrown back and forth between the screens and conveyor blades, while the liquid separated from the pellets passes through the screens and is removed through the discharge port of the housing receiving the centrifugal dryer.

Furthermore, air is sucked from above into the process space, part of the air exiting with the dried pellets and the other part being blown or sucked off from a lower-lying area of the centrifugal dryers in countercurrent to the pellets. This air countercurrent prevents pellets from being remoistened with liquid droplets formed upon impingement of the pellets.

Such centrifugal dryers have proved successful in principle. A disadvantage is the contamination of the screens with fragments of the pellets so that said screens must be dismantled, cleaned or replaced before every change of color or grade. Furthermore, screens wear out relatively heavily, are easily damaged by frequent change, and produce abrasion on the pellets to be dried. They are therefore unsuitable for drying strongly abrading pellets such as plastic pellets filled with glass fibers. Also, the sound emitted by impingement of the pellets on the screens is considerable. Although the outside housings of such centrifugal dryers can be insulated against excessive sound emissions, this insulation is elaborate because the accessibility of the screens requires closable openings such as flap doors, etc., on the housings.

The invention poses the problem of providing a centrifugal dryer which reduces abrasion of the pellets.

For solving this problem a substantial part, preferably at least in the upper area of the hollow body, is formed as an unperforated jacket. The liquid separated from the pellets flows downward in a spiral shape on the inside wall of the unperforated jacket under the action of the centrifugal and gravitational acceleration. The unperforated jacket with its smooth inside surfaces causes little abrasion.

Depending on the wall thickness the unperforated jacket causes little sound so that the hollow body can simultaneously serve as an outside housing where it is formed as an unperforated jacket.

Preferably at most the lower area of the hollow body is equipped with screen segments, or the hollow body is formed completely as an unperforated jacket with a screen in the lower area of the hollow body.

The main advantage of the invention is that only small screen surfaces, if any, need be cleaned or replaced before a change of color or grade. Pellet residues adhering to smooth walls are easily rinsed off with the aid of washing nozzles or by flooding the total process space, whereas they become wedged in screen holes. In addition, the at least partial omission of an outside housing enclosing the process space reduces costs.

The figures show two examples.

Figure 1:
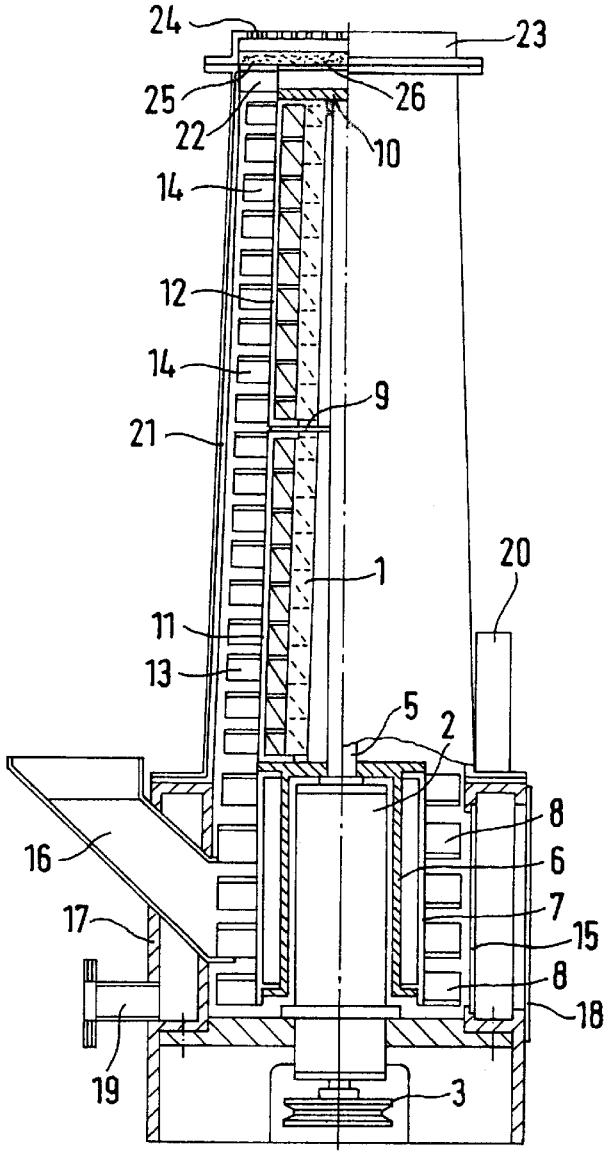
FIG. 1 shows a partial longitudinal section through a centrifugal dryer whose rotor is enclosed by a screen jacket with an outside housing only in the lower area.
Figure 2:
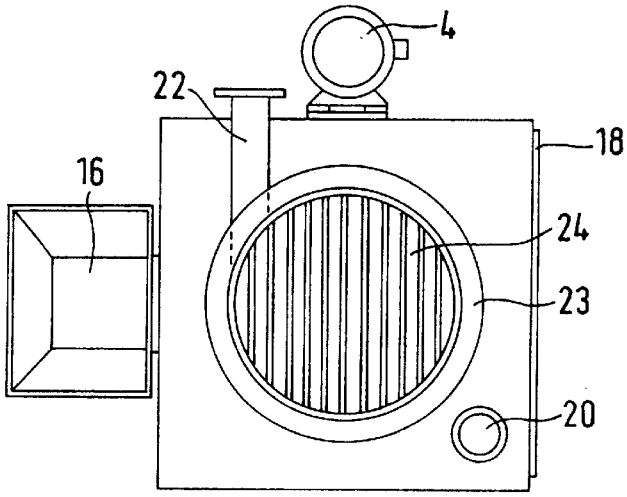
FIG. 2 shows a plan view of the centrifugal dryer according to FIG. 1.

According to FIGS. 1 and 2, the shaft (5) of the rotor (1) of a centrifugal dryer is pivotally mounted in a bearing housing (2) and adapted to be set rotating via a pulley (3) by a motor (4) shown in FIG. 2. The rotor (1) consists of a pot (6) enclosing the bearing housing (2) and having mounted thereon a plurality of holders (7) for the lower conveyor blades (8), and an intermediate disk (9) and an upper disk (10) for fastening the middle and upper holders (11, 12) for the middle and upper conveyor blades (13, 14).

The pot (6) of the rotor (1) is enclosed coaxially by fixed screen segments (15) and a feed chute (16) which are fastened to a cubical outside housing (17) provided with at least one detachable or swing-out plate (18) for mounting the screens, a discharge port (19) and an air blow-off pipe (20). The upper area of the rotor (1) is enclosed by an unperforated jacket (21) flanged on the outside housing (17), flaring downward in a frustoconical shape and having a pellet discharge port (22) closed by a cover (23) with an air intake grate (24), a filter mat (25) and a support grid (26).

Figure 3:
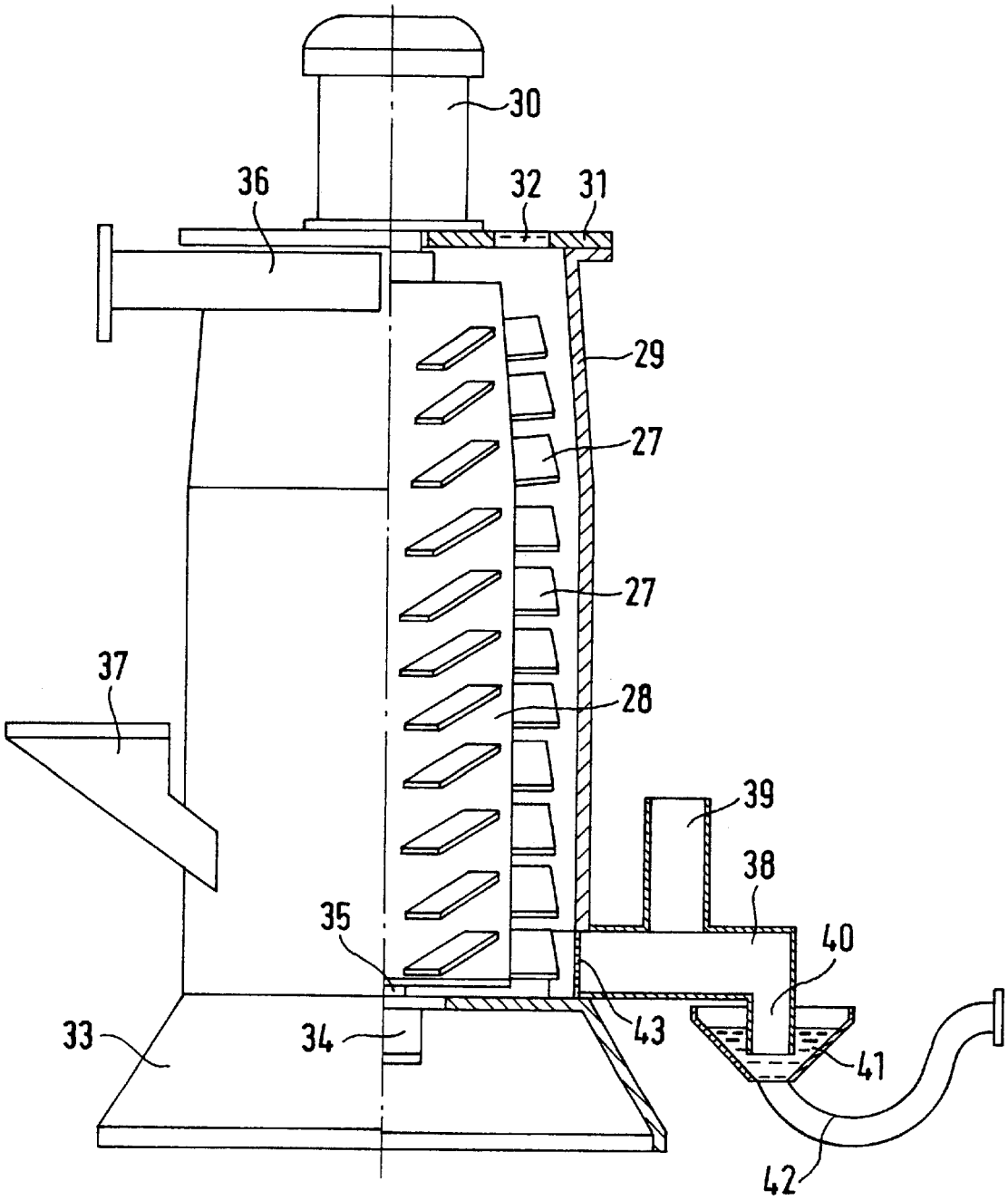
FIG. 3 shows a partial longitudinal section through a centrifugal dryer whose hollow body enclosing the rotor is formed completely as an unperforated jacket.

FIG. 3 shows a centrifugal dryer whose rotor (28) equipped with conveyor blades (27) and formed as a closed hollow body is enclosed completely by an unperforated Jacket (29) having a cylindrical/conical shape. The motor (30) coupled directly with the rotor (28) is flanged on the cover (31). The cover (31) contains air intake openings (32). The lower shaft (35) of the rotor (28) is pivotally mounted in a bearing housing (34) which is located in the base (33).

At the upper end of the unperforated jacket (29) there is a tangential pellet discharge port (36), in the lower area a feed chute (37) and a downcomer (38). The downcomer (38) bears an air blow-off pipe (39) and has a vertical pipe (40) which dips into the continuous-flow vessel (41) with a siphon (42). Between the unperforated jacket (29) and the downcomer (38) a screen (43) may be mounted.

Centrifugal dryers according to FIGS. 1 and 2 work as follows.

The feed chute (16) is charged continuously with suspension. The conveyor blades (8, 13, 14) set obliquely upward and receding in the direction of rotation accelerate the pellets and throw them between themselves and the surrounding wall both upwardly and back and forth until they are thrown out of the pellet discharge port (22).

The liquid is hurled in the lower area against the screen segments (15) into the outside housing (17). In the unperforated jacket (21) it flows downward in a spiral shape on the inside wall thereof until it likewise flows through the screen segments (15). The total liquid leaves the centrifugal dryer through the discharge port (19). Air sucked in through the cover (23) is blown off partially with the pellets, partially through the air blow-off pipe (20). To strengthen the air flow a suction fan can be connected to the air blow-off pipe (20).

The mode of working of the centrifugal dryer according to FIG. 3 differs from that according to FIGS. 1 and 2 insofar as the rotor is enclosed completely by an unperforated jacket (29) so that the total liquid flows downward on the inside wall thereof and passes through the relatively small screen (43), if present, before the downcomer (38). According to the example, the vertical pipe (40) of the downcomer dips into the liquid level of the continuous-flow vessel (41) with a siphon (42). This assembly is provided in case a suction fan is connected to the air blow-off pipe (39).

The surface of the small screen (43) suffices in particular when the liquid content of the supplied suspension is low.

The invention is not limited to the examples. For example, the downcomer (38) of a centrifugal dryer according to FIG. 3 can be designed to swing out so that the screen (43) can be replaced with little manipulation. It is also possible to do without the screen (43) completely and recirculate the draining liquid, which may contain some pellets, into a preceding thickener. Suspensions of liquids and pellets are easily thickened, the screens of static thickeners hardly tend to clog, are easy to clean and are better accessible than the screens of centrifugal dryers, which may be opened only with safety measures.

As tests have shown, the unperforated jacket (21, 29) can also be continuously cylindrical. Although the liquid drains more slowly on the inside wall of a cylinder than in a downwardly flaring cone, the costs ultimately decide which shape of jacket and rotor (1, 28) is more expedient. Even if a strictly cylindrical jacket must be somewhat longer or have a greater diameter than a jacket with a frustoconical area to attain the same separation results, its manufacture may be more cost-effective.

What is claimed is:

1. A centrifugal dryer for pellets comprising:

a vertically disposed rotor equipped with conveyor blades;

an unmoved hollow body coaxially enclosing the rotor;

a pellet discharge port disposed at the upper end of the hollow body; and a discharge for centrifuged liquid at the lower end of the hollow body, wherein a suspension of pellets and liquid is supplied into a space between the rotor and the hollow body, wherein the suspension is accelerated and hurled against an inside wall of the hollow body by means of the rotor, wherein the liquid of the suspension drains on the inside wall of the hollow body, and wherein a substantial part of the hollow body located in the centrifugal reach of the rotor is formed as a closed jacket.

2. A centrifugal dryer according to claim 1, wherein at least an upper area of the hollow body is formed as a closed jacket.

3. A centrifugal dryer according to claim 1, wherein at most the lower area of the hollow body enclosing the rotor is equipped with screen segments disposed in an outside housing for removing the liquid separated from the pellets.

4. A centrifugal dryer according to claim 1, wherein the hollow body enclosing the rotor is formed completely as a closed jacket with a screen in the lower area of the hollow body for removing the liquid separated from the pellets.

5. A centrifugal dryer according to claim 4, wherein the hollow body is formed with openings for a feed chute, a pellet discharge port and a downcomer behind the screen for the liquid.

6. A centrifugal dryer according to claim 5, wherein the downcomer is adapted to swing out.

7. A centrifugal dryer according to claim 5, wherein a vertical pipe of the downcomer dips into a continuous-flow vessel with a siphon and a suction fan is connected to an air blow-off pipe mounted on the downcomer.

8. A centrifugal dryer according to claim 1, wherein the discharge of the centrifugal dryer leads to a thickener.

9. A centrifugal dryer according to claim 1, wherein the closed jacket is cylindrical.

10. A centrifugal dryer according to claim 1, wherein the closed jacket is frustoconical.

11. A centrifugal dryer according to claim 1, wherein the upper area of the closed jacket flares downward in a frustoconical shape and is cylindrical therebelow.

12. A centrifugal dryer according to claim 1, wherein the area of the hollow body formed as a closed jacket forms a part of the outside housing of the centrifugal dryer.

13. A centrifugal dryer for pellets wherein a suspension of pellets and liquid is supplied continuously into the space between a vertically disposed rotor equipped with conveyor blades and a hollow body coaxially enclosing the rotor, having a pellet discharge port disposed at the upper end of the hollow body, and a discharge for the centrifuged liquid at the lower end of the hollow body, characterized in that a substantial part of the hollow body is a closed jacket;

wherein the hollow body enclosing the rotor is formed completely as a closed jacket with a screen in the lower area of the hollow body for removing the liquid separated from the pellets;

wherein the hollow body is formed with openings for a feed chute, a pellet discharge port and a downcomer behind the screen for the liquid; and wherein the downcomer is adapted to swing out.

14. A centrifugal dryer for pellets wherein a suspension of pellets and liquid is supplied continuously into the space between a vertically disposed rotor equipped with conveyor blades and a hollow body coaxially enclosing the rotor, having a pellet discharge port disposed at the upper end of the hollow body, and a discharge for the centrifuged liquid at the lower end of the hollow body, characterized in that a substantial part of the hollow body is a closed jacket;

wherein the hollow body enclosing the rotor is formed completely as a closed jacket with a screen in the lower area of the hollow body for removing the liquid separated from the pellets;

wherein the hollow body is formed with openings for a feed chute, a pellet discharge port and a downcomer behind the screen for the liquid;

and wherein a vertical pipe of the downcomer dips into a continuous-flow vessel with a siphon and a suction fan is connected to an air blow-off pipe mounted on the downcomer.

* * * * *